United States Patent [19]

Stephenson et al.

[11] 4,350,299

[45] Sep. 21, 1982

[54] REMOTE DELIVERY NOZZLE AND PRESSURIZED CONTAINER ASSEMBLY

[75] Inventors: George M. Stephenson, 190 Chestnut Ridge, Bethel, Conn. 06801; David L. Begin, Brookfield, Conn.; Roger Casavant, Winsted, Conn.; Stephen Bornemeier, Ridgefield, Conn.; William J. Colucci, Danbury, Conn.

[73] Assignee: George M. Stephenson, Bethel, Conn.

[21] Appl. No.: 164,319

[22] Filed: Jun. 30, 1980

[51] Int. Cl.[3] ..... B05B 7/32

[52] U.S. Cl. ..... 239/337; 222/402.14; 222/518; 239/573; 239/586; 239/588; 251/321; 251/335 A; 401/190

[58] Field of Search ..... 222/402.14, 402.13, 222/402.15, 402.11, 182, 514, 518, 509; 401/190; 239/337, 586, 588, 573, 574; 251/321, 335 A

[56] References Cited

U.S. PATENT DOCUMENTS

| | | | |
|---|---|---|---|
| 605,049 | 5/1898 | Nicholsburg | 239/586 |
| 2,536,428 | 1/1951 | Dimitri et al. | 222/402.14 |
| 2,735,590 | 2/1956 | Ayres | 222/402.11 |
| 3,129,892 | 4/1964 | Tillman | 239/586 |
| 3,199,732 | 8/1965 | Strachan | 222/182 |
| 3,224,645 | 12/1965 | Frost | 222/182 |
| 3,314,646 | 4/1967 | Austin | 251/321 |
| 3,373,907 | 3/1968 | Batrow | 222/509 |
| 3,410,492 | 11/1968 | Douglas et al. | 239/573 |
| 3,765,573 | 10/1973 | Landsman | 222/402.14 |
| 3,981,597 | 9/1976 | Cohn | 222/402.13 |
| 4,092,974 | 6/1978 | Zenzaburo | 222/402.14 |
| 4,278,188 | 7/1981 | Stephenson et al. | 222/182 |

FOREIGN PATENT DOCUMENTS

| | | | |
|---|---|---|---|
| 21673 | of 1883 | Fed. Rep. of Germany | 251/321 |
| 443432 | 12/1948 | Italy | 251/321 |

*Primary Examiner*—John J. Love
*Assistant Examiner*—Michael J. Forman
*Attorney, Agent, or Firm*—Kramer & Brufsky

[57] ABSTRACT

A remote delivery nozzle assembly is adapted to be releasably connected to a pressurized container to permit delivery of the pressurized contents thereof to a location remote from the container. A cap assembly is connected through a flexible conduit to a wand for delivery of the pressurized contents of the container. Upon seating of the cap assembly on the container, the valve of the container is opened pressurizing the wand through the flexible conduit. The wand includes a flexible membrane which when depressed by finger pressure opens a valve between the pressurized inlet and an outlet passage to deliver the pressurized fluid.

23 Claims, 9 Drawing Figures

REMOTE DELIVERY NOZZLE AND PRESSURIZED CONTAINER ASSEMBLY

TECHNICAL FIELD

The present invention relates to a remote delivery nozzle for a pressurized container and an improved connector assembly for coupling the nozzle to the container.

BACKGROUND OF PRIOR ART

Space limitations often prevent the use of portable pressurized containers such as pressurized aerosol cans at the workstation point where the pressurized container contents are required. For example, in removing dust particles from cameras, projectors and optical lenses, in cleaning film gates, tape recording heads and tape deck rollers and reels, in cleaning intricate internal parts of electric motors, switch mechanisms and other electrical components, in cleaning the type bars of typewriters or in removing dust and foreign particles from intricate mechanisms such as sewing machines, gear trains and other minute precision assemblies, the manipulation of a pressurized container of solvent or compressed gaseous cleaning agents is often impossible.

In addition, the weight and awkwardness of manually holding a pressurized container such as an aerosol can for long periods of time often proves fatiguing to those engaged in close delicate work.

For these reasons there is a need for practical and convenient pressurized containers providing remote delivery of the container contents.

In such remote delivery systems, local manual control at the remote delivery station is required to avoid wasting the pressurized gas, and an overriding "arming" and "disarming" control is required at the pressurized container to avoid the loss of escaping pressurized gas from the flexible conduit or the connecting fittings, which are thereby relieved of internal pressure loads except when remote delivery operations are required.

Several devices have been proposed to provide this dual release valve capability. U.S. Pat. No. 3,410,492 and 3,428,224 both show complex and expensive, multiple-part, container valve actuating mechanisms providing the desired overriding shut-off control of the pressurized fluid at the pressurized container itself. These complex and expensive devices are not well adapted for cooperation with conventional aerosol cans, and they involve serious risk of leakage losses of pressurized contents.

Another remote delivery nozzle system is disclosed in U.S. Pat. No. 3,650,438 assigned to the same assignee as the present application, the disclosure of which patent is hereby incorporated by reference. The remote delivery nozzle system disclosed in such prior patent comprises a pressure control assembly mounted on the top of the pressurized container and also includes an eccentric connector coupling the valve stem of the container to an elongate flexible tube employed to deliver the pressurized contents to a remote release nozzle. An eccentrically-apertured rotatable container cap cooperates with the eccentric connector to tilt the valve stem of the container when the cap is rotated thereby supplying "arming" pressure from the container through the flexible conduit to the manually actuated remote release nozzle.

The remote nozzle is formed as an elongated, hollow wand-like device having an internal bore communicating at the end of the nozzle with a release valve. The valve is a tiltable aerosol-can type release valve employing an inverted mushroom-shaped valve stem having an enlarged underlying flange upturned around its edge and maintained in sealing contact with the underside of an elastomer washer by a helical coil spring compressed between the flange and an internal shelf formed within the bore inside the nozzle. Depression or tilting of the release valve separates the flange from the elastomer washer by deforming the resilient spring, thereby connecting the bore within the nozzle through a lateral metering orifice to the delivery bore of the release valve. When the internal bore of the remote release nozzle is supplied with pressurized gas, actuation of the valve releases this pressurized gas for delivery through a delivery orifice.

A length of flexible tubing sealingly joined to the lower end of the bore of the release nozzle connects the release nozzle with the pressurized container, such as an aerosol can. The tubing extends through the eccentric aperture formed in the upper portion of the rotatable cap.

While this prior art remote delivery nozzle assembly is satisfactory in most respects, it is subject to several serious objections. For example, the eccentric connector and valve cap require precise alignment in order to operate properly and are not entirely suitable for use with those types of pressurized cans having a valve stem assembly which requires substantial downward movement, rather than merely tilting thereof, in order to allow escape of the pressurized contents through the valve stem. More significantly, because the eccentric connector extends through an eccentric aperture in the valve cap, minor leakage of the pressurized contents between the valve stem of the container and the eccentric connector sometimes occurs which results in escape of the contents through the aperture in the cap, thereby wasting the contents. Also, because the user is required to fit the eccentric connector onto the valve stem of the container prior to fitting the cap onto the container, the valve stem is often tilted or depressed during the fitting thereof with the eccentric connector, thereby allowing escape of the contents between the valve stem and the eccentric connector, which in some cases is not only wasteful but also contaminates the area adjacent the container.

Further, the tiltable valve on top of the remote delivery nozzle or wand for delivering the pressurized contents of the container at the remote location is not very accurate, causing waste of the pressurized contents. Finger fatigue is also a problem when attempting to hold the valve open for any protracted period of time.

In U.S. patent application Ser. No. 883,551, also assigned to the same assignee as the present application, a remote delivery nozzle assembly for a pressurized container is disclosed which seeks to rectify certain of the deficiencies noted above. This disclosure is also incorporated herein by reference.

According to that invention, a connector element extends through the top of a cylindrically shaped cap which is adapted to frictionally engage the upstanding annular rim on a standard aerosol can type container. The connector element is secured to the cap by means of a friction fit interlock while an O-ring provides sealing engagement between the connector element and the cap to provide a gas-tight enclosure surrounding the valve stem of the container. The connector element includes an elongated bore therethrough into the opposite ends of which the valve stem of the container and a flexible conduit are respectively received. The connector element includes shoulder portions within the bore which sealingly engage the end of the valve stem and urge the latter downwardly to release the pressurized contents when the cap is fitted onto the pressurized container. The connector assembly is installed on the container by merely fitting the cap onto the upstanding rim of the container, thereby eliminating the need for separately aligning and fitting the connector element onto the valve stem before the cap is installed. Once installed on the container, the connector assembly automatically "arms" the remote delivery nozzle. "Disarming" is effected simply by removing the cap from the container.

While the pressure control portion of the remote delivery nozzle assembly constitutes a distinct improvement in "arming" or pressurizing the remote delivery nozzle by simply disposing the cap on the container, the friction fit of the cap on the top rim or lip of the container is not all that satisfactory, since the cap is merely clamped to the outside of the lip by being spread and clampingly engaged to the outer surface. Movement of the container can result in dislodgment of the cap and "disarming" of the remote nozzle. Further, when the cap is voluntarily removed so as to "disarm" the remote nozzle, there is no shield against a spray from the pressurized container, until the container valve is closed. This often results in the user or the surrounding environs being sprayed with a foreign chemical substance.

The invention disclosed in this application, also does not make any improvements in the wand or remote delivery nozzle, which is the same as that disclosed in U.S. Pat. No. 3,650,438.

SUMMARY OF THE INVENTION

In accordance with the present invention, a remote delivery nozzle assembly includes a cap assembly having a substantially cylindrically shaped cap which is adapted to clampingly engage an inner and outer portion of the upstanding annular rim on a standard aerosol can type container. The cap has an outer flange which is resilient and spread to engage the outer diameter of the can rim. A plurality of interior, resilient, downwardly extending prongs, each terminating in a radially extending hook, seat along spaced portions of the inner diameter of the can rim, which along with the outer flange, firmly clamps the cap to the can rim.

The cap also includes a downwardly extending, annular, interior flange which serves as a shield against a spray emanating from the pressurized container when the cap is removed to "disarm" the container. The container is "armed" by the cap which has a central bore therethrough having an annular shoulder within the interior thereof which sealingly engages the end of the container valve stem and urges the latter downwardly to release the pressurized contents when the cap is fitted on the can rim. A flexible connector or conduit is received within the cap bore.

The cap has an annular, externally threaded extension which receives a nut and ferrule to clamp the flexible connector within the bore of the cap. The flexible connector or conduit conducts the pressurized contents of the container to a remote delivery nozzle or wand connected to the opposite end of the connector by a similar ferrule and nut, for delivery at a site remote from the container.

The nozzle or wand includes an elongated pencil-like member having an octagonal cross-section. The flat surfaces on the eight-sided member enables the wand to be readily gripped by the user, who must maintain a proper orientation of the wand lip. The wand includes an elongated inlet passage connected to the "armed" or pressurized container through the flexible conduit and an elongated outlet passage in communication with a suitable attachment, such as a hollow tube terminating in an application brush. A manually operable valve assembly is interposed between the pressurized inlet passage and the outlet passage.

The valve assembly includes a plug welded to the top of the wand or nozzle and a vertically reciprocable plunger biased by a spring held captive between the plug and plunger to a position sealing communication between the inlet and outlet passages. A thin button-like membrane is provided on the wand body immediately below the plunger, which when depressed will move the plunger towards the plug against the bias of the spring between the plug and plunger, establishing communication between the inlet and outlet passages to enable pressurized fluid to be dispensed through the remote outlet passage in the nozzle or wand to the application brush. Release of finger pressure on the membrane enables the plunger to return to seal communication between the inlet and outlet passages. If desired, a cap can be disposed on the membrane to reinforce the membrane. Such a wand assures accurate application of the pressurized contents of the container with a minimum of finger fatigue.

BRIEF DESCRIPTION OF THE DRAWINGS

Further objects and advantages of the invention will become apparent from the following description and claims, and from the accompany drawings, wherein:

DETAILED DESCRIPTION OF THE PREFERRED EMBODIMENT

Figure 1:
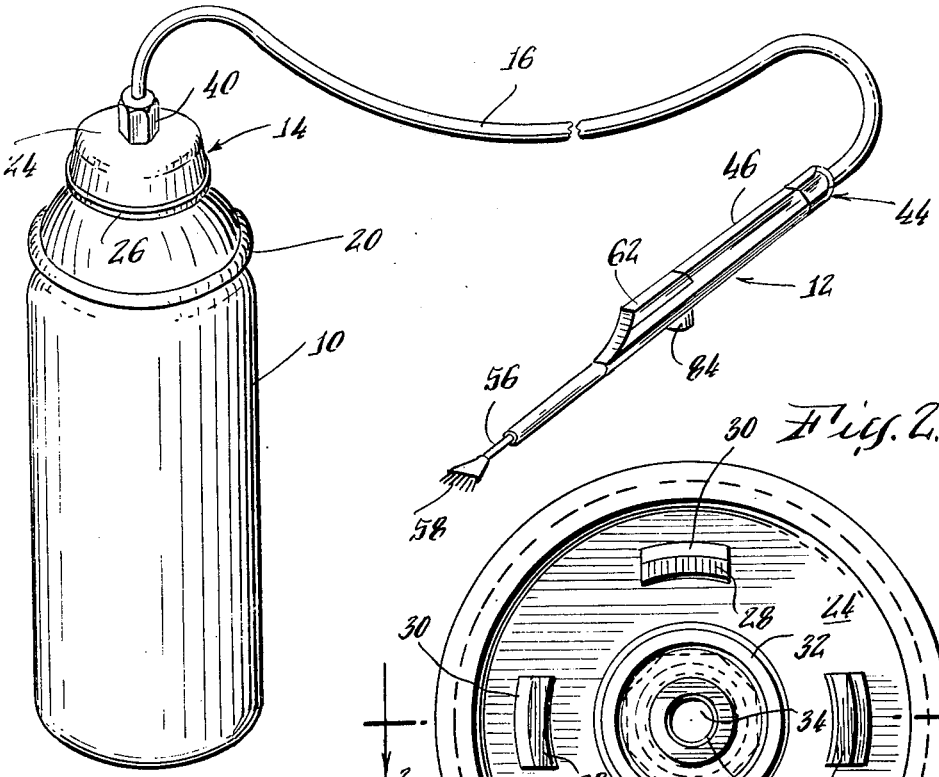
FIG. 1 is a perspective view of the remote delivery nozzle and pressurized container assembly of the present invention.
Figure 2:
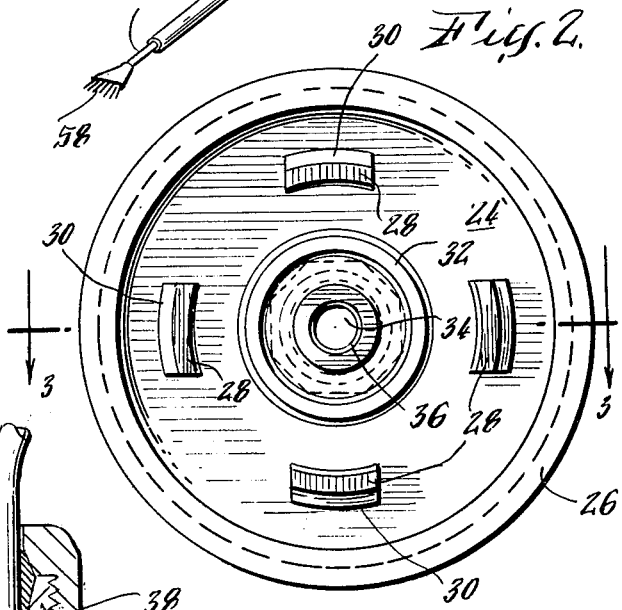
FIG. 2 is a bottom plan view of the cap assembly portion of the remote delivery nozzle and pressurized container assembly of FIG. 1 which is mounted on a pressurized container to "arm" the container.
Figure 3:
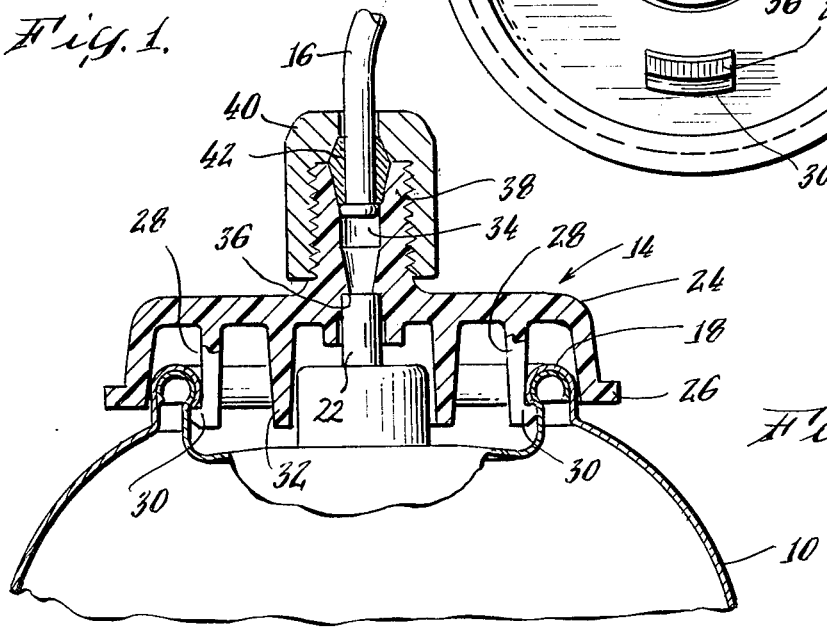
FIG. 3 is a cross-sectional view of the cap assembly taken substantially along the plane indicated by line 3—3 of FIG. 2.

Referring now to the drawings in detail wherein like numerals indicate like elements throughout the several views, a portable pressurized container, such as an ordinary pressurized aerosol-type container can 10 has a remote delivery nozzle or wand 12 connected thereto by means of a cap assembly 14 and a flexible conduit 16. The container 10 may be filled with any suitable contents under pressure, such as a cleaner or solvent, which is desired to be delivered to a remote location by means of the remote delivery nozzle 12. Container 10 is cylindrical in shape and is provided with inner and outer, annularly spaced, upstanding, concentric rims, 18 and 20, respectively. A storage and shipping cap (not shown) may be installed on the can 10 in frictional engagement with the outer rim 20 when the cap assembly 14 and remote delivery nozzle 12 are removed during periods of non-use.

The container 10 is provided with an upstanding hollow valve stem 22 which is centrally disposed in the top of the container 10. The valve stem 22 forms a part of a valve arrangement which is manufactured integral with the container 10 and is well known in the art. Such valve arrangement will typically include means (not shown) for biasing the valve stem 22 upwardly, such that a downwardly directed force on the valve stem 22 generally aligned with the longitudinal axis of the container 10 produces downward displacement of the valve stem 22, thereby opening the associated valve and allowing the pressurized contents to flow out of the container 10 through the valve stem 22.

Cap assembly 14 includes substantially cylindrically shaped cap 24 which is adapted to clampingly engage an inner and outer portion of the upstanding inner annular rim 18 on container 10. The cap 24 has an outer flange 26 which is resilient and spread to engage the outer diameter of the can rim 18. A plurality of interior, resilient, downwardly extending prongs 28, each terminating in a radially extending hook 30, seat along spaced portions of the inner diameter of the can rim 18, which along with the outer flange 26, firmly clamps the cap 24 to the can rim 18.

The cap 24 also includes a downwardly extending, annular, interior flange 32 which surrounds valve 22 and serves as a shield against a spray emanating from the pressurized container 10 when the cap 24 is removed to "disarm" the container. The container 10 is "armed" by the cap 24 which has a central bore 34 therethrough having an annular shoulder 36 within the interior thereof which sealingly engages the end of the container valve stem 22 and urges the latter downwardly to release the pressurized contents when the cap 24 is fitted on the can rim 18. An end of flexible connector or conduit 16 is received within the cap bore 34.

The cap 24 has an annular, externally threaded extension 38 which receives a nut 40 and an internal ferrule 42 surrounding conduit 16 within bore 34 to clamp the flexible connector 16 and ferrule 42 within the bore 34 of the cap 24. The flexible connector or conduit 16 conducts the pressurized contents of the container 10 to the remote delivery nozzle or wand 12 connected to the opposite end of the connector 16 by a similar ferrule and nut assembly 44 for delivery at a site remote from the container 10.

The nozzle or wand 12 includes an elongated pencil-like member 46 having an octagonal cross-section. The flat surfaces 48 on the eight-sided member enables the wand 12 to be readily gripped by the user, who must maintain a proper orientation of the wand lip 50. The wand 12 includes an elongated inlet passage 52 connected to the "armed" or pressurized container 10 through the flexible conduit 16 and an elongated outlet passage 54 in communication with a suitable attachment, such as a hollow tube 56 terminating in an application brush 58. A manually operable valve assembly 60 is interposed between the pressurized inlet passage 52 and the outlet passage 54.

Figures 4, 5, 6, 7, 8, 9:
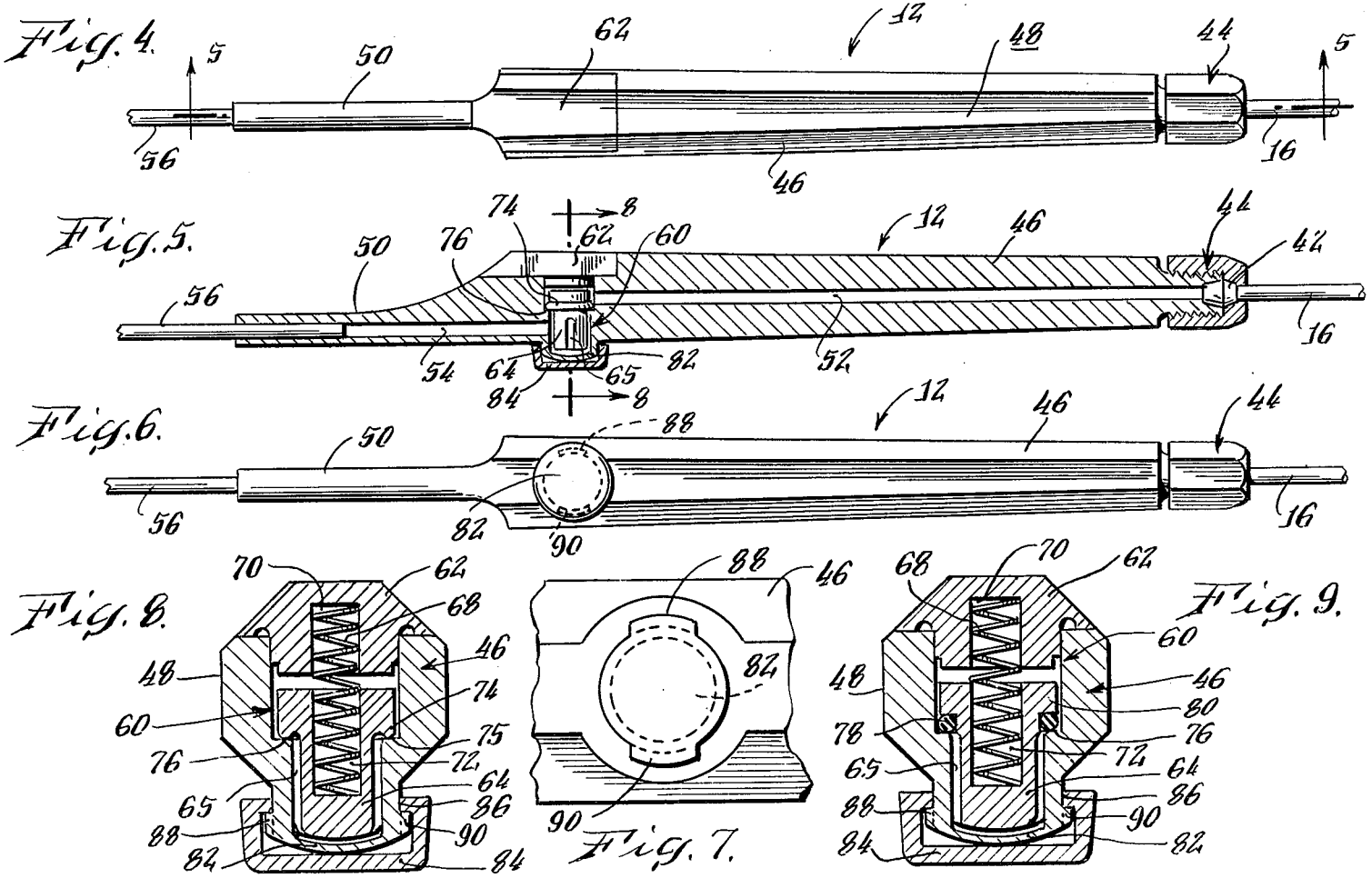
FIG. 4 is a top plan view of the wand or remote delivery nozzle portion of the remote delivery nozzle and pressurized container assembly of FIG. 1.
FIG. 5 is a cross-sectional view of the nozzle taken substantially along the plane indicated by line 5—5 of FIG. 4.
FIG. 6 is a bottom plan view of the nozzle of FIG. 5.
FIG. 7 is an enlarged detailed view of the membrane portion of the nozzle of FIG. 6.
FIG. 8 is a cross-sectional view of the valve assembly in the nozzle taken substantially along the plane indicated by line 8—8 of FIG. 5.
FIG. 9 is a view similar to FIG. 8, but illustrating an alternative form of valve assembly.

The valve assembly 60 includes a plug 62 welded to the top of the wand or nozzle 12 and a vertically reciprocable plunger 64 each housed within a transverse bore 65 between inlet passage 52 and outlet passage 54. The plunger 64 is biased by a spring 68 held captive between facing bores 70 and 72 in the plug 62 and plunger 64, respectively, to a position sealing communication between the inlet and outlet passages 52 and 54. The seal is effected by an annular rib 74 having a lower portion 75 seated on an annular shoulder 76 surrounding bore 65 (see FIG. 8) to preclude communication of passage 52 with passage 54 through bore 65 or by an O-ring 78 disposed between an annular flange 80 and shoulder 76 (see FIG. 9). A thin button-like membrane 82 is provided on the wand 12 immediately below the plunger 64, which when depressed or flexed will contact and move the plunger 64 upwardly against the bias of the spring 68 between the plug 62 and plunger 64, establishing communication between the inlet and outlet passages 52 and 54 through transverse bore 65 by moving annular rib 74 (FIG. 8) or flange 80 (FIG. 9) away from shoulder 76 (and O-ring 78) enabling pressurized fluid to be dispensed through the remote outlet passage 54 in the nozzle or wand 12 to the applicator brush 58. Release of finger pressure on the membrane 82 enables the plunger 64 to return to seal communication between the inlet and outlet passages under the return urging of spring 68 and fluid in inlet passage 52.

If desired, a cap 84 can be disposed about the membrane 82 to reinforce the membrane. Cap 84 has an annular, inwardly directed flange 86 adapted to be received and snapped over diametrically opposed, radial lips 88 and 90 extending outwardly from membrane 82 to preclude the cap 84 from falling off the membrane.

Such a wand construction assures accurate application of the pressurized contents of the container 10 with a minimum of finger fatigue. The wand 12, conduit 16 and cap assembly 14 can all be constructed from a suitable plastic material, such as polyethylene.

It is also within the scope of the invention that the central bore 34 of cap 24 can be shaped to contact and open other types of container valve stems 22 to "arm" the container 10. For example, the central bore 34 can be provided with a camming shoulder or shim to contact and cant or pivot downwardly the commonly used pivotable valve stem.

What is claimed is:

1. A remote delivery nozzle assembly adapted to be connected to a pressurized container for delivery of the pressurized contents of the container to a location remote from the container, the container being provided with an upstanding rim concentrically surrounding an upstanding hollow valve stem for releasing the pressurized contents of the container therefrom in response to shifting of the valve stem relative to the container from a normal disarmed mode position to a depressed armed mode position, said assembly comprising an elongated wand member having a substantially parallel inlet and outlet passage, remote valve means in a transverse bore between said inlet and outlet passage in said wand for selectively controlling the release of the pressurized contents from said container, said valve means including reciprocably mounted plunger means in said transverse bore for opening and closing communication between said inlet and outlet passage in response to movement thereof, flexible membrane means on said wand member for contact with said plunger means to impart movement to said plunger means in response to pressure applied thereto, and a cap member to be seated on said flexible membrane means for imparting pressure to said flexible membrane means when pressed, conduit means coupled to the inlet passage in said wand member for carrying the pressurized contents of said container from said container to said inlet passage, means for releasably connecting the valve stem of the container with said conduit means, said connecting means including cap means for enclosing said valve stem having an annular peripheral resilient flange provided with an edge adapted to frictionally engage the outer surface of the upstanding rim of the container and a plurality of interior, downwardly extending resilient prongs adapted to frictionally engage the inner surface of the upstanding rim of the container to removably mount said cap means on said container by clamping the rim between said interior prongs and peripheral flange, said cap means including a bore therethrough, said conduit means extending through said bore in said cap means and secured to the latter, and said cap means further including a shoulder within said bore adapted to engage said valve stem and force the latter to shift from a disarmed mode position therof to an armed mode position thereof when said cap means is installed on said container.

2. The nozzle assembly of claim 1 wherein said valve means further includes a plug fixed to said wand member having a portion extending into said transverse bore, an annular shoulder forming a valve seat on said wand member surrounding said transverse bore between said parallel inlet and outlet passages, an annular flange on said plunger means for forming a seal between said plunger means and annular shoulder, and spring means extending between said plug and plunger means for urging said annular flange on said plunger means into sealing relation with said annular shoulder on said wand member.

3. The nozzle assembly of claim 2 wherein said flange includes an annular rim adapted to contact said annular shoulder to form said seal.

4. The nozzle assembly of claim 2 including on O-ring between said flange on said plunger means and annular shoulder on said wand member to form said seal when said spring means urges said plunger means towards said annular shoulder.

5. The nozzle assembly of claim 1 wherein said wand member includes a hollow conduit having a cleaning appliance on one end thereof in communication with said outlet passage therein.

6. The nozzle assembly of claim 1 wherein said cap means further includes a downwardly dependent annular flange concentric with the outer edge thereof between said bore therethrough and said downwardly extending prongs to serve as a shield against spray issuing from said container valve stem upon removal of said cap means from said container and disarming of the container valve stem.

7. The nozzle assembly of claim 6 wherein said cap means further includes an externally threaded extension member having an extension of said bore in said cap means therethrough and nut means received on the threaded portion of said extension member for locking said conduit means in said extension member.

8. The nozzle assembly of claim 1 wherein said wand member has a polygonal cross-section including a plurality of flat planar surfaces.

9. The nozzle assembly of claim 8 wherein said cross-section is octagonal in shape.

10. A wand for a remote delivery nozzle assembly adapted to be connected to a pressurized container comprising:

an elongated member having a substantially parallel inlet and outlet passage, remote valve means in a transverse bore between said inlet and outlet passage in said wand, for selectively controlling the release of the pressurized contents from said container, said valve means including reciprocably mounted plunger means in said transverse bore for opening and closing communication between said inlet and outlet passage in response to movement thereof, flexible membrane means on said wand member for contact with said plunger means to impart movement to said plunger means in response to pressure applied thereto, and a cap member adapted to be seated on said flexible membrane means for imparting pressure to said flexible membrane means when pressed.

11. The wand of claim 10 wherein said valve means further includes a plug fixed to said wand member having a portion extending into said transverse bore, an annular shoulder forming a valve seat on said wand member surrounding said transverse bore between said parallel inlet and outlet passages, an annular flange on said plunger means for forming a seal between said plunger means and annular shoulder, and spring means extending between said plug and plunger means for urging said annular flange on said plunger means into sealing relation with said annular shoulder on said wand member.

12. The wand of claim 11 wherein said flange includes an annular rim adapted to contact said annular shoulder to form said seal.

13. The wand of claim 11 including an O-ring between said flange on said plunger means and annular shoulder on said wand member to form said seal when said spring means urges said plunger means towards said annular shoulder.

14. The wand of claim 10 wherein said wand member includes a hollow conduit having a cleaning appliance on one end thereof in communication with said outlet passage therein.

15. A remote delivery nozzle assembly adapted to be connected to a pressurized container for delivery of the pressurized contents of the container to a location remote from the container, the container being provided with an upstanding rim concentrically surrounding an upstanding hollow valve stem for releasing the pressurized contents of the container therefrom in response to shifting of the valve stem relative to the container from a normal disarmed mode position to a depressed armed mode position, said assembly comprising an elongated wand member having a substantially parallel inlet and outlet passage, remote valve means in a transverse bore between said inlet and outlet passage in said wand for selectively controlling the release of the pressurized contents from said container, said valve means including reciprocably mounted plunger means in said transverse bore for opening and closing communication between said inlet and outlet passage in response to movement thereof, a plug fixed to said wand member having a portion extending into said transverse bore, an annular shoulder forming a valve seat on said wand member surrounding said transverse bore between said parallel inlet and outlet passages, an annular flange on said plunger means for forming a seal between said plunger means and annular shoulder, and a spring extending between said plug and plunger means for urging said annular flange on said plunger means into sealing relation with said annular shoulder on said wand member, said plunger means having a cavity therein into which a longitudinal portion of said spring is inserted, flexible membrane means on said wand member for contact with said plunger means to impart movement to said plunger means in response to pressure applied thereto, and a cap member adapted to be seated on said flexible membrane means for imparting pressure to said flexible membrane means when pressed, conduit means coupled to the inlet passage in said wand member for carrying the pressurized contents of said container from said container to said inlet passage, means for releasably connecting the valve stem of the container with said conduit means, said connecting means including cap means for enclosing said valve stem having an annular peripheral resilient flange provided with an edge adapted to frictionally engage the outer surface of the upstanding rim of the container and a plurality of interior, downwardly extending resilient prongs adapted to frictionally engage the inner surface of the upstanding rim of the container to removably mount said cap means on said container by clamping the rim between said interior prongs and peripheral flange, said cap means including a bore therethrough, said conduit means extending through said bore in said cap means and secured to the latter, and said cap means further including a shoulder within said bore adapted to engage said valve stem and force the latter to shift from a disarmed mode position thereof to an armed mode position thereof when said cap means is installed on said container.

16. The nozzle assembly of claim 15 wherein said cap means further includes a downwardly dependent annular flange concentric with the outer edge thereof between said bore therethrough and said downwardly extending prongs to serve as a shield against spray issuing from said container valve stem upon removal of said cap means from said container and disarming of the container valve stem.

17. The nozzle assembly of claim 16 wherein said cap means further includes an externally threaded extension member having an extension of said bore in said cap means therethrough and nut means received on the threaded portion of said extension member for locking said conduit means in said extension member.

18. The nozzle assembly of claim 15 wherein said wand member has a polygonal cross-section including a plurality of flat planar surfaces.

19. The nozzle assembly of claim 18 wherein said cross-section is octagonal in shape.

20. The nozzle assembly of claim 19 wherein said cap means further includes a downwardly dependent annular flange concentric with the outer edge thereof between said bore therethrough and said downwardly extending prongs to serve as a shield against spray issuing from said container valve stem upon removal of said cap means from said container and disarming of the container valve stem.

21. The nozzle assembly of claim 20 wherein said cap means further includes an externally threaded extension member having an extension of said bore in said cap means therethrough and nut means received on the threaded portion of said extension member for locking said conduit means in said extension member.

22. A wand for a remote delivery nozzle assembly adapted to be connected to a pressurized container comprising:

an elongated member having a substantially parallel inlet and outlet passage, remote valve means in a transverse bore between said inlet and outlet passage in said wand, for selectively controlling the release of the pressurized contents from said container, said valve means including reciprocably mounted plunger means in said transverse bore for opening and closing communication between said inlet and outlet passage in response to movement thereof, a plug fixed to said wand member having a portion extending into said transverse bore, an annular shoulder forming a valve seat on said wand member surrounding said transverse bore between said parallel inlet and outlet passages, an annular flange on said plunger means for forming a seal between said plunger means and annular shoulder, and, a spring extending between said plug and plunger means for urging said annular flange on said plunger means into sealing relation with said annular shoulder on said wand member, said plunger means having a cavity therein into which a longitudinal portion of said spring is inserted, flexible membrane means on said wand member for contact with said plunger means to impart movement to said plunger means in response to pressure applied thereto, and a cap member adapted to be seated on said flexible membrane means for imparting pressure to said flexible membrane means when pressed.

23. The wand of claim 22 wherein said wand member includes a hollow conduit having a cleaning appliance on one end thereof in communication with said outlet passage therein.

* * * * *